United States Patent [19]

Strauss

[11] Patent Number: 5,025,624

[45] Date of Patent: Jun. 25, 1991

[54] PROCESS FOR REGULATING THE FUEL/AIR RATIO IN INTERNAL COMBUSTION ENGINES

[75] Inventor: Wolfgang Strauss, Denkendorf, Fed. Rep. of Germany

[73] Assignee: Daimler-Benz AG, Fed. Rep. of Germany

[21] Appl. No.: 433,121

[22] Filed: Nov. 8, 1989

[51] Int. Cl.[5] ..... F01N 3/20

[52] U.S. Cl. ..... 60/274; 60/276

[58] Field of Search ..... 60/274, 277, 27 C

[56] References Cited

U.S. PATENT DOCUMENTS 4,461,258 7/1984 Becker ..... 123/489
4,509,327 4/1985 Enga ..... 60/274
4,617,794 10/1986 Fujitani ..... 60/274
4,651,695 3/1987 Ohtaki ..... 123/492

*Primary Examiner*—Douglas Hart
*Attorney, Agent, or Firm*—Evenson, Wands, Edwards, Lenahan & McKeown

[57] ABSTRACT

In a process for regulating the fuel/air ratio in internal combustion engines having an exhaust gas measuring probe and a catalyst, the fuel/air mixture fed to the internal combustion engine via a proportioning device being regulated to a virtually stoichiometric value in a control unit with variable characteristics as a function of the exhaust gas composition detected by the measuring probe, the characteristics of the control unit are variable in dependence on the operating time of the catalyst.

5 Claims, 1 Drawing Sheet

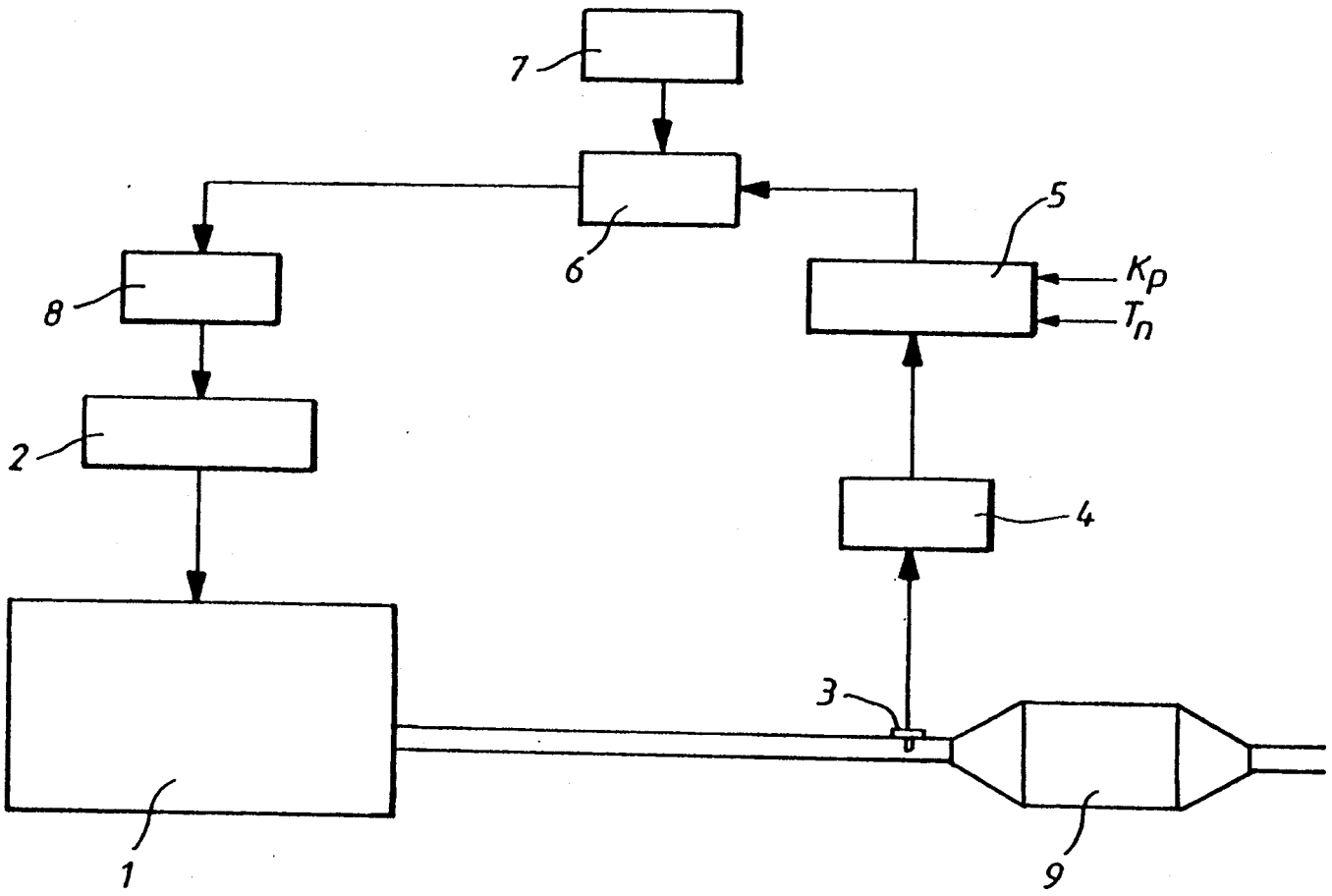
Kp
Tn
5
4
9
3
7
6
8
2
1

PROCESS FOR REGULATING THE FUEL/AIR RATIO IN INTERNAL COMBUSTION ENGINES

BACKGROUND AND SUMMARY OF THE INVENTION

The present invention generally relates to a process for regulating the fuel/air ratio of internal combustion engines, and more particularly to a process for fuel/air regulation in which changes in catalyst conditions, for example, as the result of ageing, are compensated German Published, Unexamined Patent Application 3,537,530 describes an arrangement for regulating the fuel/air ratio of an internal combustion engine. The fuel/air ratio supplied to the internal combustion engine is detected in a known way by an oxygen sensor arranged in an exhaust gas path. An output signal from the oxygen sensor is subsequently compared, in a comparator, with a value representing the ideal stoichiometric value of the fuel/air mixture, and the result is fed to a proportional-plus-integral (PI) control unit. From the input signal having two variables, this control unit generates a step/ramp function as an output signal. This signal is compared with a triangular pulse train, thereby generating square-wave pulses which activate an electromagnetic valve in order to make the fuel/air mixture richer or leaner.

The characteristics of the PI control unit can be varied in order to rapidly match the regulation to changed operating conditions, for example the acceleration of the internal combustion engine. However, the control system, although responding very quickly to changed operating conditions, nevertheless does not respond to changed catalyst conditions. These changes can occur, for example, as a result of the ageing of the catalyst. The lower conversion rate of the catalyst necessarily associated with ageing consequently cannot be compensated.

Thus, an object of the present invention is to provide a fuel/air regulation arrangement of the relevant generic type in such a way that changes in the catalyst, for example as a result of ageing, are compensated.

According to preferred embodiments of the invention, this and other objects are achieved by changing one or both of the characteristics of the PI control unit, that is to say changing the proportional sensitivity or the reset time, in dependence on the running distance of the catalyst, the regulation being matched as closely as possible to the state of ageing of the catalyst.

Other objects, advantages and novel features of the present invention will become apparent from the following detailed description of the invention when considered in conjunction with the accompanying drawings.

BRIEF DESCRIPTION OF THE DRAWING

The single FIGURE illustrates various components for understanding the process according to one embodiment of the present invention.

DETAILED DESCRIPTION OF THE DRAWING

An exemplary embodiment of the invention will be described below with reference to the drawing.

The single FIGURE illustrates an internal combustion engine 1, to which a fuel/air mixture is fed via a fuel/air proportioning device 2. The residual oxygen content still present in the exhaust gases of the internal combustion engine is detected by an exhaust gas measuring probe 3 designed as an oxygen probe. The sensed residual oxygen content is compared in a comparator 4 with a quantity corresponding to the ideal stoichiometric value. The output signal of this comparator 4 activates a proportional-plus-integral (PI) controller 5, a regulating variable of which has a known step/ramp signal waveform as a function of the output value of the comparator 4.

This step/ramp signal is compared, in a second comparator 6, with a triangular pulse train generated by a generator 7. As a result of this comparison, a square-wave pulse train of varying duty factor is obtained. Depending on their duty factor, the square-wave pulses control in a different way an electromagnetic valve 8, via which the fuel/air proportioning device 2 and consequently the fuel/air ratio supplied to the internal combustion engine 1 are influenced.

With increasing ageing of the catalyst 9, that is to say with an increasing operating time, its conversion rate necessarily decreases. To overcome this disadvantage, the setting of the controller 5 is changed by means of its characteristics. Thus, for example, a signal obtained from the operating time of the catalyst 9 can be used to reduce the reset time $T_n$ of the controller 5, that is to say increase the gradient of the ramp of the step/ramp function.

This corresponds to a more rapid compensation of deviations of the fuel/air ratio from the ideal stoichiometric value and can therefore correct a lower conversion rate of the catalyst 9 . Of course, the behavior of the controller can also be changed by influencing the proportional factor $K_p$ or by influencing both characteristics simultaneously. At the same time, evidence of the state of ageinq of the catalyst 9 can be obtained in a simple way by evaluating the operating time or the running distance covered by the vehicle with this catalyst.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. Process for regulating a fuel/air ratio of internal combustion engines having an exhaust gas measuring probe and a catalyst in an exhaust gas path, a fuel/air mixture fed to the internal combustion engine via a proportioning device being regulated to a substantially stoichiometric value by a control unit with variable characteristics as a function of exhaust gas composition detected by the measuring probe, the process comprising the steps of:

determining an operation time of the catalyst which reflects the catalyst aging and consequent decrease in conversion rate; and varying characteristics of the control unit in dependence on the operating time of the catalyst to thereby accommodate decreases in the catalyst conversion rate.

2. Process for regulating a fuel/air ratio of internal combustion engines having an exhaust gas measuring probe and a catalyst in an exhaust gas path, a fuel/air mixture fed to the internal combustion engine via a proportioning device being regulated to a substantially stoichiometric value by a control unit with variable characteristics as a function of exhaust gas composition detected by the measuring probe, the process comprising the steps of:

determining an operation time of the catalyst;

varying characteristics of the control unit in dependence on the operating time of the catalyst; and wherein the step of varying characteristics of the control unit comprises at least one of reducing a reset time of the control unit and varying a proportional factor thereof.

3. Process according to claim 2, wherein the step of varying characteristics of the control unit comprises reducing a reset time of the control unit.

4. Process according to claim 2, wherein the step of varying characteristics of the control unit comprises varying a proportional factor of the control unit.

5. Process according to claim 2, wherein the step of varying characteristics of the control unit comprises both reducing a reset time of the control unit and varying a proportional factor thereof.

* * * * *